United States Patent [19]

Herlin

[11] Patent Number: 4,773,622

[45] Date of Patent: Sep. 27, 1988

[54] SELF-ERECTING DISPLAY DEVICE

[75] Inventor: Robert M. Herlin, Jupiter, Fla.

[73] Assignee: Graphics 3, Inc., Jupiter, Fla.

[21] Appl. No.: 70,560

[22] Filed: Jul. 7, 1987

[51] Int. Cl.[4] ..... B65D 5/08; B65D 5/36; B65D 5/52

[52] U.S. Cl. ..... 248/174; 40/539; 206/44 R; 229/110; 248/152

[58] Field of Search ..... 248/174, 152, 300; 211/189; 40/124.1, 539, 610; 206/44 R; 229/41 B, 50, 109, 110

[56] References Cited

U.S. PATENT DOCUMENTS

| | | | |
|---|---|---|---|
| 1,689,155 | 10/1928 | Rittenhouse | 40/312 |
| 2,347,155 | 4/1944 | Leahey | 40/124.1 X |
| 3,267,597 | 8/1966 | Jannes | 40/124.1 X |
| 3,571,958 | 3/1971 | Stevens | 40/124.1 |
| 3,921,897 | 11/1975 | Noyes et al. | 229/41 B X |
| 3,949,933 | 4/1976 | Giambrone et al. | 229/50 |
| 4,586,649 | 5/1986 | Webinger | 248/174 X |
| 4,619,426 | 10/1986 | Drueck, Jr. | 248/174 |

*Primary Examiner*—Alvin C. Chin-Shue

*Attorney, Agent, or Firm*—Banner, Birch, McKie & Beckett

[57] ABSTRACT

There is disclosed a stand-up panel for a collapsible self-erecting display device, such as an advertising or novelty device, in which the panel is adapted to be pinched between adjacent side edges of the sidewalls of the device when it is in its erected position to hold the panel upright and is adapted to be released by the side edges whereby it can fall flat onto the display device when it is in its collapsed condition.

10 Claims, 2 Drawing Sheets

SELF-ERECTING DISPLAY DEVICE

BACKGROUND OF THE INVENTION

This invention relates to a self-erecting display device of paperboard or the like that is collapsible to a flat condition and adapted to be expanded to an erected condition by elastic means such as a rubber band, and more particulalry to a display panel for use on such a display device.

Collapsible self-erecting hollow display devices have heretofore been used, for example, as novelty or advertising devices. One such device of this nature that has been made and sold by applicant comprises a self-erecting structure with two endwalls—a topwall and a bottomwall—connected together by pairs of sidewalls that are hingedly connected together at one edge and hingedly connected at their opposite ends to the edges of the endwalls. Elastic means such as a rubber band is disposed inside the display device and is connected at each end to one of the pairs of sidewalls on opposite sides of the display device—the connection being made adjacent to the interconnecting fold between the two sidewalls of each of the pairs of sidewalls. Such devices have been used, for example, as a calender with hexagonal endwalls on which the advertiser's name or message appears and with six sidewalls secured to each of the endwalls. to provide a total of twelve sidewalls on which the months of the year are displayed.

Similar self-erecting devices have also been provided with upstanding display panels on one of the endwalls—such as the topwall. In the Drueck U.S. Pat. No. 4,619,426, for example, there is shown a collapsible self-erecting device having an upstanding advertising panel in which the panel includes a tab extending downwardly from the bottom edge thereof through a slot in the topwall of the device. The tab is formed with a hook to which one end of the rubber band is attached so that, when the display is in the erected condition, tension in the rubber band not only pulls the endwalls together to hold the device in the erected condition, but also causes the display panel to stand up on the topwall. A display panel of this nature is limited in that it requries attachment to the rubber band, which in turn requires that it be on the wall of the device to which the rubber band is normally connected or that there be two rubber bands—one for moving the device to its erected condition and one for holding the panel in a stand-up condition—which adds to the manufacture and assembly of the device.

Another self-erecting display device with a stand-up portion is shown, for example, in the Ditzler et al U.S. Pat. No. 2,601,374. In this case, the stand-up portion is an integral part of the display and again requires connecting the stand-up panel to the elastic element.

Stand-up display panels for cartons or containers are also known, for example, from the Rittenhouse U.S. Pat. No. 1,689,155 and the Robbins U.S. Pat. No. 1,448,767. These devices, however, are not collapsible self-erecting devices and they are mounted separately on the carton or container.

It is an object of this invention to provide a stand-up panel for a collapsible self-erecting display device in which the panel can be readily added to the display device and will function along with the display device as it is moved between the collapsed and erected conditions.

SUMMARY OF THE INVENTION

In accordance with this invention, there is provided a stand-up display panel for a collapsible self-erecting display device in which the display panel is adapted to be pinched between the edges of the sidewalls of the display device as the display device moves into the erected condition, thus causing the display panel to be held upright in the plane defined by the edges of the sidewalls while, at the same time, permitting the panel to fall flat as the device is collapsed into a flat condition and the edges of the sidewalls thus separate.

DETAILED DESCRIPTION

Figure 1:
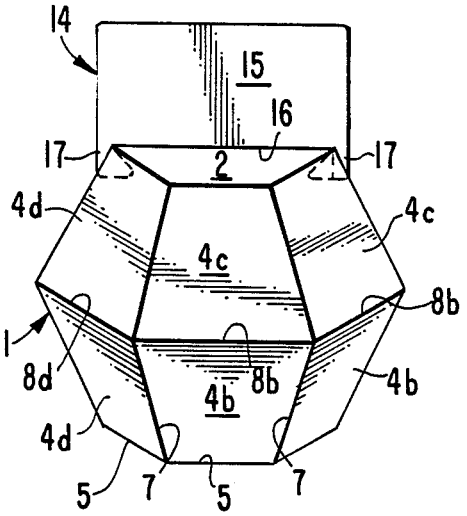
FIG. 1 is a perspective view of a display device in accordance with this invention.
Figure 3:
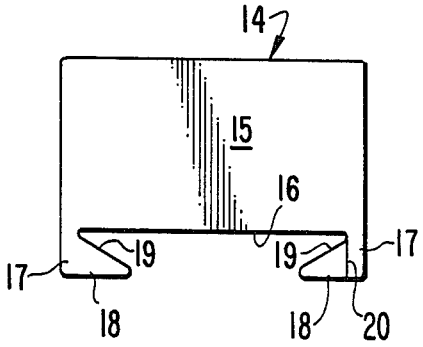
FIG. 3 is a view of the display panel shown in FIG. 1.
Figure 4:
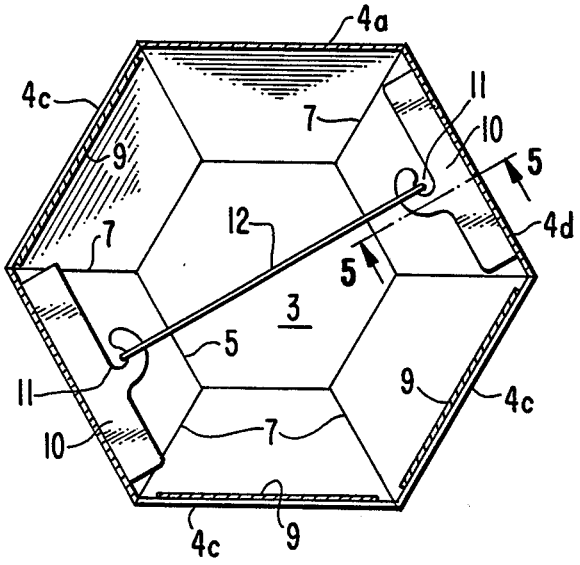
FIG. 4 is a horizontal sectional view through the display device of FIG. 1 at substantially the vertical midpoint thereof.
Figure 5:
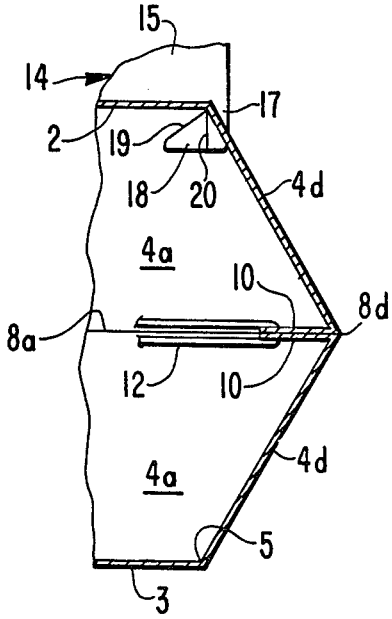
FIG. 5 is a fragmentary vertical secitonal view taken substantially on line 5—5 of FIG. 4.
Figure 6:
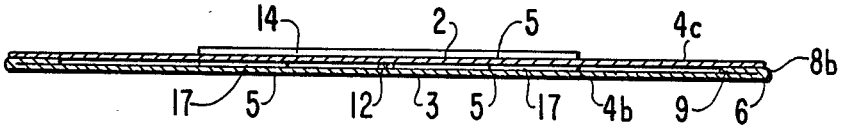
FIG. 6 is a vertical sectional view of the display device of FIG. 1 in which the device is in its collapsed condition.

With reference to the drawings, there is shown a display device 1 that is substantially ball-like in configuration and is formed from a single blank of sheet material such as paperboard or the like. The device includes a pair of opposed substantially identical endwalls comprising a topwall 2 and a bottomwall 3 that are polygonal and, preferably as shown, hexagonal. Quadrilateral sidewalls 4 (FIG. 2), equal in number to the number of side edges of the topwall 2 and bottomwall 3, are hingedly connected one to each edge of the endwalls 2 and 3 along foldlines 5, which, with the hexagonal endwalls, provides six sidewalls on each of the endwalls, a total of twleve sidewalls. As shown, the sidewalls 4 specifically are formed as isoscoles trapezoids.

Figure 2:
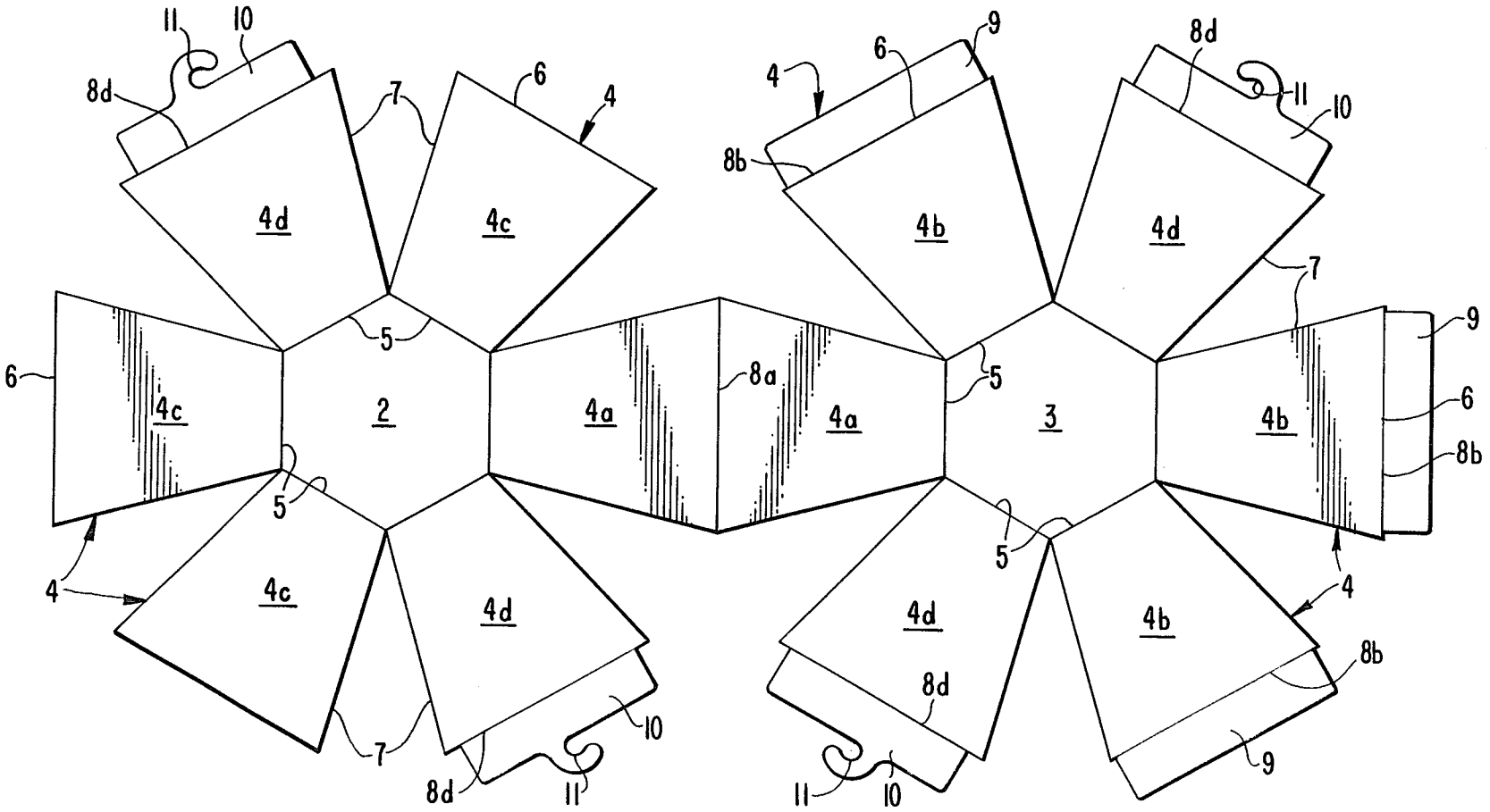
FIG. 2 is a plan view of the blank from which the display device of FIG. 1 is formed.

Each of the sidewalls 4 has an inner end at the foldline 5 with the respective endwalls 2 and 3 and an outer end 6, and a pair of side edges 7 that diverge outwardly from the inner end to the outer end thereof. The side edges 7 of the sidewalls 4 also diverge outwardly relative to the adjacent side edges 7 of the adjacent sidewalls when the device is flat, that is, as a blank as shown in FIG. 2 or when the assembled device is collapsed.

The sidewalls 4 include a first pair of walls **4*a* that are integral along the outer ends thereof to define a foldline 8*a* about which the two sidewalls 4*a* are initially folded in assembling the device. Three of the sidewalls 4*b* on one of the endwalls 2 or 3—which as shown in FIG. 2 is the bottomwall 3—are each provided with a connecting portion 9 on the outer edge thereof that is adapted to be folded about a foldline 8*b* in assembling the device and to be secured as by adhesive to the inner surface of a corresponding sidewall 4*c* on the other endwall—the topwall 2—along the outer ends 6**.

The other two sidewalls **4*d* of each of the endwalls 2 and 3, which are diametrically opposed on the endwalls 2 and 3, are each provided with a connecting portion 10 that is integral with the respective sidewall on a foldline 8*d*. Each of the connecting portions 10 is adapted to be secured adhesively face to face to the connecting portion 10 on the corresponding sidewall on the other of the endwalls. The connecting portions 10 are also formed with hooks 11 for receiving the elastic means, such as a rubber band 12, when the device is assembled and thus for attaching the elastic band 12 to the sidewalls 4 adjacent foldlines 8***d* at the outer ends 6 thereof.

When the display device as above described is collapsed against the tension of the rubber band 12, the sidewalls 4 bend about the foldlines 5 into the plane of the respective endwalls 2 and 3, while each pair of sidewalls bend about their common foldline 8*a*, 8*b* or 8*d* into a flat arrangement in which each sidewall overlies the corresponding sidewall on the other endwall and the two endwalls overlie each other. The display device can be shipped in this condition in an envelope that holds the same collapsed against the tension of the rubber band 12.

When the device is released, as for example, when it's removed from the envelope, the elastic band 12 contracts and pulls the two opposite pairs of the sidwalls 4*d* inwardly toward each other. With the ends of the rubber band 12 attached to the hooks 11 of the connecting portions 10, its pull is exerted at the foldline 8*d* between the pairs of sidewalls 4*d*. Thus, as the device moves into its erected condition, the sidewalls 4*d* act as a toggle to separate the endwalls 2 and 3 as the sidewalls 4*d* tend to straighten about the foldlines 8*d*. As the endwalls 2 and 3 separate, the pairs of walls 4*a* and 4*b*/4*c* are also straightened about their common foldlines 8*a* and 8*b* and bend about their foldlines 5.

The rubber band 12 continues to straighten sidewalls 4*d* until the side edges 7 thereof come into engagement with the adjacent side edges of the adjacent sidewalls 4*a*, 4*b* and 4*c*. With the side edges 7 of the sidewalls 4 all in engagement, the device is resiliently locked in its erected condition by the elastic band 12.

In accordance with this invention, there is provided a display panel 14 that is adapted to be mounted at the top of the device 1. The panel 14 is also planar and formed of paperboard or the like and has a sign portion 15 that is designed to receive, for example, an advertising or novelty message. The panel 14 has a bottom edge 16 along the bottom of the sign portion 15 that is only slightly longer than the width of the topwall 2 between the opposite corners where the edges 7 come together at the foldlines 5. A tab 17 depends from the sign portion 15 outwardly of and below the bottom edge 16 and includes a hook portion 18 having an upper edge 19 spaced from the bottom edge 16 of the panel and defining therewith a slot for receiving the edge of the topwall 2 whereby the hook portion 18 extends beneath and holds the display panel on the topwall 2.

To assemble the display panel on the topwall 2, one of the tabs 17 is provided with a foldline 20 at the end of and normal to the bottom edge 16 so that the hook portion 18 of the tab 7 can be folded back on the balance of the tab. With the device slightly collapsed to open a gap between the side edges 7 of each of the adjacent sidewalls 4, the tab 17 that does not have the foldline 20 can be inserted into the gap. The other tab 17 can then be folded on the foldline 20 so that the portion thereof that normally underlies the topwall 2 is clear of the edge of the topwall 2 and the tab can thus be inserted into the gap between the side edges 7 between the two adjacent sidewalls 4 on the opposite side of the device. Once inserted into the gap, the folded portion of the tab 17 will recover and the panel 15 is thus loosely retained on the topwall 2.

With the tabs 17 extending into gaps between the side edges 7 of the sidewalls 4, the tab is pinched between the edges of the sidewalls as the gap is closed when the device moves into its erected condition under the tension of the rubber band 12. The tabs 17 and thus the panel 14 are thereby moved to and held in an upright position on the topwall 2 when the device is in the erected condition. At the same time, when the device is collapsed, the tabs 17 are released as the side edges 7 of the sidewalls 4 separate and the panel 14 falls flat agaisnt the topwall 2. The tabs 17 remain between the topwall 2 and the bottomwall 3 and between the inner surface of the sidewalls 4. When the device is released from its collapsed position and snaps to its erected condition under the tension of the spring 12, the panel 14 is forced to a stand-up position on the topwall 2 as the gap between the sidewalls 7 close on the tabs 17.

With a display device having an even number of sidewalls, such as the six shown in the preferred embodiment, the panel 14 is arranged diametrically across the topwall 2 and in alignment with the side edges 7 of the sidewalls 4 on the opposite sides of the topwall 2 or, in other words, in the plane defined by those side edges 7. With an odd number of sidewalls, the panel 14 would be off-center on the topwall 2 and may be pinched between side edges 7 at one side only. Alternatively, the panel 14 can be dimensioned to extend between side edges 7 that are not aligned with each other or, in other words, are not in a common vertical plane, and it may for example be bowed.

The angle at which the sidewalls 4 extend from the foldlines 5 of the topwall 2 and bottomwall 3 when the device is erected is a function of the angle at which the side edges 7 of the sideewall 4 diverge. With devices in which the sidewalls are more rectangular in shape, the angle is greater than as shown with the trapezoidal sidewalls and each pair of sidewalls 4 is more straight or more co-planar about their foldline 8, and thus more normal to the topwall 2 and bottomwall 3 when the side edges 7 abut. The endwall 2 and bottomwall 3 are thus further apart in the erected condition and the device is more cylindrical in shape. Conversely, when the angle of the side edges 7 is increased, the side edges 7 will abut sooner and thus define a more flat device. With the angles of the sidewalls 4 selected to provide a substantially ball-shaped device, the side edges 7 of the sidewalls diverge outwardly and downwardly from the edges of the topwall 2 sufficiently to receive the tabs 17 extending substantially downwardly relative to the topwall 2. However, for a device that is more cylindrical in shape—in which the sidewalls are more normal to the topwall 2—the tab portions 17 can be extended and turned inwardly into the gap between the side edges 7 of the sidewalls to provide increased contact between the tab 17 and the side edges 7.

The sidewalls 4 as shown are in the form of identical isoscoles trapezoids and the side edges 7 of the sidewalls 4 are thus all in planes normal to the topwall 2 and bottomwall 3 when the device is in its erected condition. The angles of the sidewalls can also vary somewhat to produce irregular shapes so that when the side edges 7 of the sidewalls abut in the erected condition, they are not normal to the sidewalls and, thus, the panel 14 can be tilted forwardly or backwardly.

Other modifications of the invention will be obvious to those skilled in the art.

I claim:

1. A collapsible self-erecting display device formed of paperboard or the like comprising a pair of polygonal endwalls and quadrilateral sidewalls corresponding in number to the number of side edges of said endwalls, means for hingedly connecting each of said sidewalls at its inner end along a second foldline to the outer end of a corresponding sidewall on the other endwall, said sidewalls having side edges that diverge outwardly from the inner ends to the outer ends thereof and diverge relative to the adjacent side edge of the adjacent sidewall when in the collapsed condition in which the sidewalls on each of the endwalls are folded about said first foldlines into the plane of the endwall and are folded about said second foldlines whereby said one endwall and the connected sidewalls are flat against the other endwall and the corresponding sidewalls, elastic means connected at its ends to two interconnected pairs of said sidewalls adjacent to said second foldlines on opposite sides of said endwall for biasing the outer ends of said sidewalls inwardly into an erected condition in which the side edges of said sidewalls abut, and a planar display panel and means positioning said panel on one of said endwalls with a portion thereof between the adjacent side edges of two adjacent sidewalls whereby said panel will lie flat on said display device in the collapsed condition and will automatically stand upright on said endwall as the portion thereof between said side edges is pinched between the same in response to the display being self-erected.

2. A self-erecting display device in accordance with claim 1 in which said means for positioning said panel on said endwall and said portion between the adjacent side edges of two adjacent sidewalls comprise a bottom edge of said panel adapted to be seated on said endwall and a tab depending from said panel outwardly of said bottom edge.

3. A self-erecting display device in accordance with claim 2 in which said tab includes a hook portion adapted to underlie said endwall.

4. A self-erecting display device in accordance with claim 1 in which said means for positioning said panel on said endwall and said portion between the adjacent side edges of two adjacent sidewalls comprise a bottom edge of said panel adapted to be seated on said endwall and a tab depending from said bottom edge at each side of said panel outwardly of said endwall.

5. A self-erecting display device in accordance with claim 4 in which said tabs include hook portions adapted to underlie said endwall.

6. A self-erecting display device in accordance with claim 1 in which said endwalls have an even number of side edges and said panel is adapted to be centered relative to said endwall.

7. A self-erecting display device in accordance with claim 1 in which said sidewalls are substantially identical isoscoles trapezoids.

8. A self-erecting display device in accordance with claim 1 in which said device is formed from a single blank of material and said means for hingedly connecting the outer ends of said sidewalls along said second foldlines includes a connecting portion integral with the outer edge of at least one of the sidewalls of a connected pair of sidewalls, said connecting portion being adapted to be folded about said second foldline and to be secured relative to the outer edge of the corresponding sidewall on the other endwall.

9. A self-erecting display device in accordance with claim 8 in which said means for connecting said elastic means to said sidewalls adjacent said second foldline comprises hooks formed on the connecting portions of two hingedly connected pairs of sidewalls on opposite sides of said endwalls.

10. A self-erecting display device in accordance with claim 9 in which the connecting portions to which said elastic means is connected comprises a connecting portion at the outer end of each of the said sidewalls of each of said pairs.

* * * * *